US006231720B1

(12) United States Patent
Mouri et al.

(10) Patent No.: US 6,231,720 B1
(45) Date of Patent: May 15, 2001

(54) RECORD SHEET FOR USE IN ELECTRO-COAGULATION METHOD

(75) Inventors: Toyohisa Mouri; Masaya Shibatani; Yutaka Hattori; Shunji Hayashi, all of Nagaizumi-cho; Toshio Takagi, Amanuma, all of (JP)

(73) Assignee: Tokushu Paper Mfg. Co., Ltd. (JP)

( * ) Notice: Subject to any disclaimer, the term of this patent is extended or adjusted under 35 U.S.C. 154(b) by 0 days.

(21) Appl. No.: 09/223,250

(22) Filed: Dec. 30, 1998

(30) Foreign Application Priority Data

Jan. 7, 1998 (JP) ..... 10-013391
Dec. 21, 1998 (JP) ..... 10-362312

(51) Int. Cl.[7] ..... D21H 19/36
(52) U.S. Cl. ..... 162/135; 162/137; 428/341; 428/342; 428/537.5
(58) Field of Search ..... 162/135, 137; 428/341, 342, 537.5

(56) References Cited

U.S. PATENT DOCUMENTS

| | | | | |
|---|---|---|---|---|
| 4,440,827 | | 4/1984 | Miyamoto et al. . | |
| 4,613,525 | * | 9/1986 | Miyamoto et al. | 427/256 |
| 4,895,629 | | 1/1990 | Castegnier et al. . | |
| 5,523,149 | | 6/1996 | Kijimuta et al. . | |
| 5,541,002 | * | 7/1996 | Hosoi et al. | 428/537.5 |

FOREIGN PATENT DOCUMENTS

| | | |
|---|---|---|
| 31 51 471A | 12/1981 | (DE) . |
| 634 287A | 7/1994 | (EP) . |
| 077 768A | 11/1996 | (EP) . |

OTHER PUBLICATIONS

Patent Abstract of Japan vol. 018, No. 682 (M–1729)/JP 06 270531A.
Patent Abstract of Japan vol. 098, No. 002/JP 09 277 695A.
Japanese Publication No. 10131091 A and English translation of the Abstract.

* cited by examiner

*Primary Examiner*—Dean T. Nguyen
(74) *Attorney, Agent, or Firm*—Pitney, Hardin, Kipp & Szuch LLP

(57) ABSTRACT

A record sheet for use in an electro-coagulation printing method, which comprises a base sheet and a layer provided thereon composed of at least one filler selected from the group consisting of alumina sol, boemite, pseudo boemite, synthetic amorphous silica, silica sol and colloidal silica and a binder, wherein said record sheet satisfies the following properties;

(i) a wet time of the record sheet obtained from a liquid absorption curve of pure water measured by a dynamic scanning absorptometer being not more than 15 milliseconds, (ii) an absorption coefficient of the record sheet obtained from a liquid absorption curve of pure water measured by a dynamic scanning absorptometer being at least 10 $ml/m^2s^{-1/2}$, and (iii) a contact ratio of the record sheet with the coagulated colloids measured by a specular reflection smoothness tester under a pressure of 40 $kg/cm^2$ with a ray having a wavelength of 0.5 $\mu m$ being at least 40% and further, (iv) a Beck smoothness of the coating layer surface measured in accordance with JIS P 8119 being 250 seconds or more.

10 Claims, 1 Drawing Sheet

RECORD SHEET FOR USE IN ELECTRO-COAGULATION METHOD

BACKGROUND OF THE INVENTION

1. Field of the Invention

The present invention relates to a record sheet for use in an electro-coagulation printing method by forming an ink layer representing an image of desired characters and pictures on a cylinder which constitutes an electrode and transferring this ink layer to the record sheet under pressure and in particular, to a record sheet having an excellent dot reproduction and tone reproduction of printed images.

2. Prior Art

The electro-coagulation printing method has been well known as disclosed in, for example, U.S. Pat. No. 3,892,645, No. 4,555,320 and No. 4,764,264, and JPA Hei 4-504688. An ink used in the electro-coagulation printing method is water ink. The water ink is composed of water, a polymer which electrolytically coagulates, a soluble electrolyte, and coloring agent. Examples of the polymer which electrolytically coagulates are albumin, gelatine, casein, agar, polyacrylate, polyacrylamide, and PVA. Examples of the soluble electrolyte are lithium chloride, sodium chloride, calcium chloride, potassium chloride, nickel chloride, copper chloride, and magnesium sulfate.

The electro-coagulation process is basically performed in the following manner. In the state that the above-described ink layer is present between a positive electrode and an negative electrode, when an electric potential is produced therebetween, colloid coagulates and adheres to the positive electrode. The coagulation takes place in the state that the colloid is colored with a coloring agent contained in the ink. By arranging the colored coagulated colloid in a pattern corresponding to a desired image, the desired image can be reproduced. By transferring the reproduced image to a record sheet by a proper method, the desired image is recorded on the record sheet.

The structure of a printer according to the electro-congulation printing method is described in the above-mentioned JPA Hei 4-504688. Referring to FIG. 1, the structure of the main part of a conventional printer according to the electro-coagulation printing method will be described in brief. FIG. 1 is a schematic diagram showing a structure of a printer for forming an image of a monochrome picture and transferring the image to a record sheet. When an image with a multiple colors is printed, a desired number of the same units are used corresponding to the number of the desired colors. In FIG. 1, reference numeral 1 depicts a metal cylinder which functions as a positive electrode. The metal cylinder is composed of a metal which is electrically inactive such as stainless steel. Two cylindrical electrodes 2 are independently disposed on the periphery of the positive electrode 1. The cylindrical electrodes 2 are insulated from the electrode 1. An amount of ink sprayed from an ink spraying device 3 is filled in a nip between the electrodes 1 and 2. The positive electrode 1 is continuously rotated in the clockwise direction in FIG. 1. With a potential difference between the positive electrode 1 and the negative electrodes 2, coagulated colloid portions and non-coagulated portions are formed in the ink filled between the positive electrode 1 and the negative electrodes 2. The coagulated colloid adheres to the positive electrode 1. Only the non-coagulated portion is selectively removed from the positive electrode by a wiper 4 or the like.

A press roll 5 is pressed against the periphery of the positive electrode 1. A record sheet 6 is traveled by the positive electrode 1 and the press roll 5. Thus, the coagulated colloid held on the periphery of the press roll 5 is placed in the position of the press roll 5 as the positive electrode 1 rotates. The coagulated colloid is contacted and transferred to the record sheet 6. At this point, the nip pressure between the press roll 5 and the positive electrode 1 is in the range from 30 to 50 kg/cm. After the coagulated colloid has been transferred to the record sheet, the positive electrode 1 is further rotated, and then cleaned by a cleaning device 7. Thereafter, a corrosion resisting agent is coated on the periphery of the positive electrode by a corrosion resisting agent coating device 8. Thus, one cycle of the printing process has been completed.

When compared with the conventional printing methods such as offset printing method, letterpress printing method, screen printing method, and gravure printing method, as a major difference, the electro-coagulation printing method is categorized as so-called "non-plate printing method". The non-plate printing method has many advantages over the conventional printing methods. In the conventional printing methods, a step for forming a printing plate is essential. The cost for the printing plate per one print sheet is usually very large. On the other hand, since the non-plate printing method does not need the printing plate forming step, the cost is greatly reduced. In addition, in the case of the conventional "plate printing method", although the step for printing the same prints can be performed at high speed, it takes a long time to replace the plates. In contrast, in the "non-plate printing method", data is received from a computer is read and printed. Thus, the preparing time for different prints is very shoot. Consequently, it can be considered that the electro-coagulation printing method is much superior to the conventional printing methods particularly in a small lot printing.

In addition, since the preparing time for printing different prints is very short, so-called page variable process where the base text of direct mails and individual addresses are printed, which is impossible in the conventional printing methods, can be performed.

Moreover, the printer using the electro-coagulation printing method is composed of relatively rigid and simple parts. Thus, the printer can be operated at high speed. The upper limit of the printing speed depends on the information transmission speed of the computer rather than the printer. With a conventional computer, the printing speed at a level of several hundred meters per minute can be satisfactorily accomplished. The printer is operated at a high speed and has a high productivity as compared with recent printers for a rapidly progressing "non-plate printing".

The coloring agents used in the electro-coagulation printing method may be the same as those used for inks in the conventional printing methods. The shape and size of the coagulated colloid in the electro-coagulation printing method are almost the same as those of the negative electrodes. In the electro-coagulation printing method, a so-called "dot gain" phenomenon does not take place on the record sheet. Thus, an image can be clearly reproduced with fine and sharp dots.

As described above, it is considered that the electro-coagulation printing method is an excellent printing method featuring high through-put and high picture quality available in the conventional printing methods. In addition, the electro-coagulation printing method has also features which are a small lot printing and a page variable property that were not available by the conventional printing methods.

The present inventors filed Japanese Patent Application No. 319038/1996 (JPA 10-131091 Laid-open on May 19, 1998) as a earlier application. This reference discloses a record sheet for an electro-coagulation printing method having such properties that a wet time and absorption coefficient obtained from a liquid absorption curve of pure water measured by a dynamic scanning absorptometer is not more than 15 milliseconds and is at least 5 $ml/m^2s^{-1/2}$, respectively in case of requiring the quality of a fine monochrome image and also, that a wet time and absorption coefficient obtained from a liquid absorption curve of pure water measured by a dynamic scanning absorptometer is not more than 15 milliseconds and is at least 10 $ml/m^2s^{-1/2}$, respectively and a contact ratio measured by a specular reflection smoothness tester under a pressure of 40 $kg/m^2$ with a ray having a wavelength of 0.5 $\mu$m is at least 40% in case of requiring the quality of a full-color image.

As mentioned above, since the electro-coagulation (hereinafter referred to as "the Elco") printing method is very excellent, when the record sheet disclosed in the above earlier application is used, a good image-reproduction is obtained. On the other hand, there have been required a record sheet improved in a dot reproduction and tone reproduction.

SUMMARY OF THE INVENTION

An object of the present invention is to provide a record sheet for use in the Elco printing method having an excellent dot reproduction and tone reproduction and suitable for a high grade-printing with the quality of a fine monochrome and full-color image such as a book of paintings and a photograph.

Another object of the present invention is to provide a record sheet for use in the Elco printing method suitable for a high-grade printing with the quality of high glossiness.

The inventors have diligently studied to attain the above objects and found that it would be an indispensable condition for improvement in transfer rate of coagulated colloids to transfer the water content from the coagulated colloids to the record sheet within a very short time while the record sheet and coagulated colloids are nipped between a positive electrode and a press roll and that a record sheet having a coating layer comprising as a main component at least one filler selected from the group consisting of alumina sol, boemite, pseudo boemite, synethetic amorphous silica, silica sol and colloidal silica and also, having a high Beck smoothness is improved in the dot reproduction, tone reproduction and optical density.

In accordance with the present invention, there is provided a record sheet for use in an electro-coagulation printing method by forming characters and images on a cylinder as a positive electrode with an ink which brings about colored-coagulated colloids by electric charge and transferring the characters and images under a pressed condition to the record sheet brought into contact with the surface of the positive electrode, said record sheet comprising a base sheet and a coating layer provided thereon composed of at least one filler selected from the group consisting of alumina sol, boemite, pseudo boemite, synthetic amorphous silica, silica sol and colloidal silica and a binder, wherein said record sheet satisfies the following properties;

(i) a wet time of the record sheet obtained from a liquid absorption curve of pure water measured by a dynamic scanning absorptometer being not more than 15 milliseconds, (ii) an absorption coefficient of the record sheet obtained from a liquid absorption curve of pure water measured by a dynamic scanning absorptometer being at least 10 $ml/m^2s^{-1/2}$, and (iii) a contact ratio of the record sheet with the coagulated colloids measured by a specular reflection smoothness tester under a pressure of 40 $kg/cm^2$ with a ray having a wavelength of 0.5 $\mu$m being at least 40% and further, (iv) a Beck smoothness of the coating layer surface measured in accordance with JIS P 8119 being 250 seconds or more.

MODE OF EMBODIMENT OF THE INVENTION

As for the base sheet of the present invention, there are exemplified papers, films, synthetic papers, coated papers, papers of high cushion and non-woven fabrics.

The term "paper" is used to mean a sheet-like material composed of, for example, wood fibers beaten by a known beater, non-wood fibers, or sheet shaped substances obtained from materials including a mixture of fillers and particular chemicals with water by a known paper machine such as Fourdrinier paper machine, cylinder paper machine, inclined paper machine or twin-wire paper machine.

Similarly, the term "film" means a sheet shaped material of which an organic resin such as viscose, acetate, polyethylene, polypropylene, poly(vinyl chloride), polystyrene, nylon, polyacetal, polyearbonate, or polyethylene terephthalate is mixed with another filler or chemicals when necessary and layered by a known method such chemicals when necessary and layered by a known method such as the melt extrusion method, the calender method, the stretching method, or the solution casting method. The film according to the present invention may include synthetic papers.

The nonwoven fabric is a sheet shaped substance made of a fiber material such as wood fiber, cotton, rayon, polyethylene terephthalate, acrylic resin, acetate, nylon, or polypropylene by a known method such as the span bond method, and the paper making method, or dry method using a card machine or a garnet machine.

These base sheet may be composed of a single layer. Alternatively, the base sheet may be more than two layers, such as a coated paper having a coating layer on the surface of the sheet, wherein the coating layer is composed of a filler and a binder.

Figure 1:
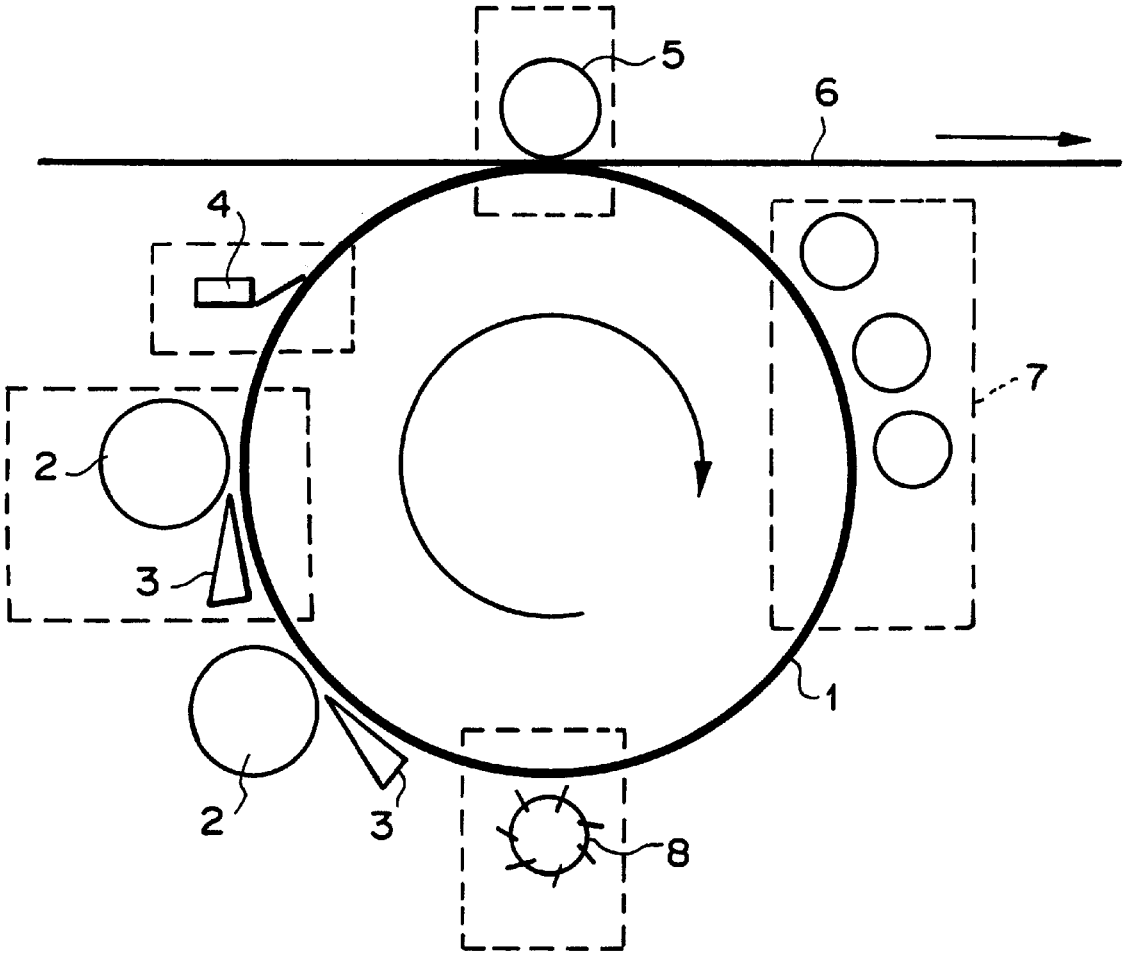
FIG. 1 is a sectional view showing a structure of principal portions of a printer according to an electro-coagulation printing method for a record sheet according to the present invention.

In the present invention, the wet time and absorption coefficient obtained from liquid absorption curve of pure water measured by a dynamic scanning absorptometer are a very important factor. When the wet time exceeds 15 milliseconds or the absorption coefficient is less than 10 $ml/m^2s^{-1/2}$, the transfer rate of coagulated colloids to the record sheet is reduced, because the water content transfer of from coagulated colloids to the record sheet does not occur during the time of coagulated colloids contacting with the record sheet. Even when the wet time and absorption coefficient satisfy the above essential conditions, if a contact area ratio of coagulated colloids with the record sheets is small, the water content transfer of from coagulated colloids to the record sheet is insufficient and therefore, the transfer rate of coagulated colloids to the record sheet is reduced.

The above transfer rate is directed to the case of a pressure of 30~50 $kg/cm^2$ being applied upon the nipping. It can not necessarily be said that there is a certain relation between the smoothness and the transfer rate of coagulated colloids in the case of no pressure being applied. For example, in case of using a newspaper of high cushion as the base sheet, the smoothness under no pressure condition is not high, nevertheless the transfer rate of coagulated colloids is higher than the case of using a paper of fine quality as the base sheet.

The inventors have revealed that there is a certain relationship between the contact ratio measured by a specular reflection smoothness tester under a pressure of 40 $kg/cm^2$ with a ray having a wavelength of 0.5 $\mu$m and the transfer rate of coagulated colloids and have found that if the contact ratio is less than 40%, the transfer rate of coagulated colloids is low. Namely, as the smoothness under pressed condition becomes higher, the contact area with coagulated colloids becomes larger. As the contact area becomes larger, the adhesion force to coagulated colloids becomes higher as well as the water-absorption ability being higher.

For satisfying the requirements of the wet time and absorption coefficient, a coating layer containing a hydrophilic filler of large water absorption as a main component is provided on a base sheet. As for such a filler, there are exemplified an alumina such as alumina sol, boemite and pseudo boemite and a silica such as synthetic amorphous silica, silica sol and colloidal silica.

Further, though the dot reproduction and tone reproduction are important factors for determining the quality of printed image, it has been found that a smoothness of the record sheet is significant for obtaining such a printed image. Herein, the smoothness is represented by Beck smoothness measured in accordance with JIS P 8119. Since the contact ratio measured by a specular reflection smoothness tester reflects a smoothness under pressed condition, larger this contact ratio, higher the transfer rate of coagulated colloid ink. On the other hand, it has been found that as the Beck smoothness under no pressure condition becomes larger, the dot reproduction and tone reproduction becomes more excellent.

For raising the smoothness, the record sheet may be subject to smoothing treatment. Particularly, the record sheet may be subject to a super calender treatment with three or more nips under nip pressure of 100 kg/cm or more, preferably 150 kg/cm or more at temperature of 40° C. to 100° C.

Alternatively, it may be subject to a soft nip calender smoothness by JIS P 8119 of 250 seconds or more, preferably 300 seconds or more, the dot reproduction and tone reproduction reach a level satisfactory for the quality of printed image.

On the other hand, a high glossiness of image is often required. When the case of using the silica filler is the same as the case of using the alumina filler in optical density of the printing, the inventors have found that the coating layer of alumina has the image glossiness higher than the coating layer of silica. This is considered due to the fact that the shape of silica is amorphous or spherical, while the alumina has an anisotropic shape such as plate, needle or tuft and thus, is oriented on the record sheet.

Accordingly, when the alumnina is used as a filler in the coating layer, a record sheet exhibiting a high glossiness of image is obtained by such a light smoothing treatment that the water-absorption performance is not reduced. As a matter of course, it is not essential requirement to effect the smoothing treatment of the record sheet.

The coating layer containing the alumina as a main component has an appropriate smoothness and image glossiness without any smoothing treatment for the second sheet.

Further, when a coating layer containing synthetic amorphous silica and silica sol as a filler is used, a record sheet presenting a printed image excellent in optical density is obtained. Also, when a coating layer containing colloidal silica as a filler is used, a record containing colloidal silica as a filler is used, a record sheet presenting a printed image excellent in the optical density and glossiness is obtained. Silica sol is, preferably, a connected spherical colloidal silica in form of a string of beads with long chain, a branched shape or bended shape thereof or a pearl necklace like shape thereof. More preferably, the spherical colloidal silica is a pearl necklace like shape which is made of spherical colloidal silica of particle size of 10 to 50 nm bound to the length of 50 to 400 nm. When such a silica sol is used, a printed image of high glossiness as well as the excellent dot reproduction and tone reproduction can be formed.

These silica sol can be prepared by the method disclosed in Japanese Patent No. 2803134. First particles of spherical colloidal silica are connected to particle-particle bond through polyvalent metal ions, 3 or more particles, preferably 5 or more particles being connected. Further, a branched shape or bended shape of connected colloidal silica particles or pearl necklace like shape are exemplified. As for the interposing polyvalent metal ions, there are exemplified divalent metals such as Ca, Mg, Sr, Ba, Zn, Sn, Db, Cu, Fe, Ni, Co and Mn, trivalent metals such as Al, Fe, Cr and Ti and tetravalent metals such as Ti, Zr and Sn.

For obtaining a printed image of high glossiness by coating the alumina, it is effective to use a base sheet of high smoothness. When the Beck smoothness of base sheet is 200 seconds or more, a high glossiness of image is obtained without smoothing treatment. In this case, since lowering of wetability due to the calender treatment does not occur, a record sheet having a very high quality of image is obtained. Further, higher glossiness of image is obtained by the calender treatment.

As for means for providing the coating layer on the base sheet, there are conventional coating means such as blade coater, roll coater, air knife coater and rod coater. Among them the use of blade coater results in formation of a record sheet with a high smoothness.

As elements for constituting the coating layer, a binder is necessary in addition to the filler. In case of using the alumina the binder should be non-anionic. This is because a binder which is anionic is reacted with the alumina to form agglomerates and thus, an application onto the base sheet becomes difficult.

On the other hand, in case of using the silica, the binder is not particularly limited.

Examples of the binder are polyvinyl alcohol, a denatured substances thereof, starch, a denatured substances thereof, casein, NR, SBR, NBR, acrylic resin, urethan resin, polyvinyl pyrolidone, a mixture thereof or a copolymer thereof.

In case of using the alumina alone, it is preferred that a ratio of binder in the coating layer is 3~60 parts by weight based on 100 parts by weight of the alumina, a specific surface area of the filler by BET method is more than 10 $m^2/g$ and an amount of oil-absorption is more than 40 ml/100 g.

When the average specific surface area of all fillers in the coat layer in the BET method is 10 $m^2/g$ or less or the average oil absorption of all the fillers is 40 ml/100 g or less, the record sheet does not satisfy the above described conditions for a full-color image and thereby the transfer ratio of the coagulated colloid for the second and later colors is reduced and also, the monochrome and full-color images are inferior in tone reproduction.

Further, when the silica only is used or a mixture of the silica and alumina is used, it is preferred that a ratio of binder in the coating layer is 10~60 parts by weight based on 100 parts by weight of the filler, a specific surface area of the filler by BET method is 10 $m^2/g$ or more and an amount of oil absorption is 40 ml/100 g or more. More preferably, the binder ratio is the range of 3~60 parts by weight in case of using colloidal silica or silica sol as the filler. If the amount of binder in the coating layer is less than 10 parts by weight based on 100 parts by weight of all the fillers, the strength of coating layer is not sufficient so that troubles such as breakage of the coating layer are caused upon the contacting and transferring of coagulated colloids to the record sheet. On the other hand, when exceeding 60 parts by weight, the color image in the second and later colors is inferior in transfer ratio and the monochrome and full-color images are inferior in tone reproduction.

When an average specific surface area of all the fillers in the coating layer by BET method is less than 10 $m^2/g$ or an average amount of oil absorption of all the fillers is less than 40 ml/100 g, the color image in the second and later colors is inferior in transfer ratio and the monochrome and full-color images are inferior in tone reproduction.

In preparing of the coating layer, a coating weight is preferably 2 $g/m^2$ or more. The coating layer may be a multilayer structure, preferably a two-layer structure. In this case a first layer is coated on the base sheet and dried, followed by further coating a second layer thereon. The record sheet thus obtained is more excellent in the dot reproduction and tone reproduction.

The present invention will be, in detail, explained with reference to Examples.

EXAMPLES

Preparation of Base Sheet A

100 Parts by weight of breached broad-leaf tree craft pulp were beaten to become 500 ml C.S.F. and then mixed with 10 parts by weight of clay, 0.3 parts by weight of a sizing agent (trade name "SIZEPINE E", producted by Arakawa Chemical Industries, Ltd.) and 2.0 parts by weight of alum. Using the resulting material, Base sheet A of high cushion having a weighing capacity of 105 $g/m^2$ and a density of 0.55 $g/cm^3$ was obtained in the conventional manner by a Fourdrinier paper machine.

Preparation of Base Sheet B 40 parts by weight of breached needle-leaved thee craft pulp and 60 parts by weight of breached broad-leaf tree craft pulp were beaten to become 500 ml C.S.F., and then mixed with 10 parts by weight of clay, 0.3 part by weight of paper strength agent (trade name "POLYSTRON 191", Arakawa agent (trade name "SIZEPINE E", Arakawa Chemical Industries, Ltd.), and 2.0 parts by weight of alum. With the resultant material, Base sheet B with a weighing capacity of 105 $g/m^2$ was fabricated by a Fourdrinier paper machine in the conventional manner. The Base sheet B is of low cushioning effect having a density of 0.75 $g/cm^3$ and a Beck smoothness of 45 seconds.

Preparation of Base Sheet C

To 80 parts by weight of water were added 80 parts by weight of kaolin (trade name "UW-90", produced by Engelhard Co., Ltd.), 20 parts by weight of heavy calcium carbonate (trade name "FMT 90", produced by Phymatec, Co.), 5 parts by weight of phosphate esterified starch (trade name "MS-4600", produced by Nihon Shokuhin Kako Co.) and 13 parts by weight of styrene-butadiene latex (trade name "Polylak 750", produced by Mitsui Chemical Co., Ltd.). The resulting solution was coated on the above Base sheet B by means of air knife coater to become a coat amount of 15 $g/m^2$. Beck smoothness of Base sheet C thus obtained is 100 seconds.

Preparation of Base Sheet D

The above Base sheet C was object to a super calender treatment with four nips under the conditions of 200 kg/cm in nip pressure, 60° C. in metal roll temperature and 200 m/min. in speed. Thus, Base sheet D having Beck smoothness of 220 seconds was obtained.

EXAMPLE 1

Into 880 parts by weight of water were incorporated 100 parts by weight of alumina sol (trade name "Alumina sol-100 produced by Nissan Chemical Industry Co., Ltd.) and 20 produced by Nissan Chemical Industry Co., Ltd.) and 20 parts by weight of polyvinyl alcohol (trade name "PVA-110", produced by Kuralay Co., Ltd.). A coating solution thus obtained was coated on the above Base sheet A by means of air knife coater to become a coat amount of 5 $g/m^2$. A sheet thus obtained was subject to a super calender treatment with four nips under the conditions of 150 kg/cm in nip pressure, 40° C. in metal roll temperature and 150 m/min. in speed. Thus, a record sheet for the Elco printing method was obtained.

EXAMPLE 2

Into 880 parts by weight of water were incorporated 100 parts by weight of boemite (trade name "alumina sol-520, produced by Nissan Chemical Industry Co., Ltd.) and 20 parts by weight of polyvinyl alcohol (the same as the above). A coating solution thus obtained was coated on the above Base sheet A by means of air knife coater to become a coat amount of 5 $g/m^2$. A sheet thus obtained was subject to a super calender treatment with four nips under the conditions of 150 kg/cm in nip pressure, 40° C. in metal roll temperature and 150 m/min. in speed. Thus, a record sheet for the Elco printing method was obtained.

EXAMPLE 3

Into 880 parts by weight by water were incorporated 100 parts by weight of pseudoboemite (prepared by heating the "alumina sol-100") and 20 parts by weight of polyvinyl alcohol (trade name "PVA-110", produced by Kuralay Co., Ltd.) A coating solution thus obtained was coated on the above Base sheet A by means of air knife coater to become a a super calender treatment with four nips under the conditions of 150 kg/cm in nip pressure, 40° C. in metal roll temperature and 150 m/min. in speed. Thus, a record sheet for the Elco printing method was obtained.

EXAMPLE 4

A record sheet for the Elco printing method was obtained in the same manner as in Example 3 except using the conditions of super calender treatment with six nips; 200 kg/cm in nip pressure; 60° C. in metal roll temperature and 150 m/min.

EXAMPLE 5

Into 880 parts by weight of water were incorporated 100 parts by weight of pseudo boemite (the same as in Example 3) and 20 parts by weight of polyvinyl alcohol (the same as the above). A coating solution thus obtained was coated on the above Base sheet D by means of air knife coater to become a coat amount of 5 $g/m^2$. Thus, a record sheet for the Elco printing method was obtained.

EXAMPLE 6

The record sheet of Example 5 was subject to a super calender treatment with six nips under the conditions of 200 kg/cm in nip pressure, 60° C. in metal roll temperature and 150 m/min. in speed. Thus, a record sheet for the Elco printing method was obtained.

EXAMPLE 7

Into 880 parts by weight of water were incorporated 100 parts by weight of psuedo boemite (the same as in Example 3) and 20 parts by weight of polyvinyl alcohol (the same as the above). A coating solution thus obtained was coated on the above Base sheet D by means of blade coater to become a coat amount of 5 $g/m^2$. Thus, a record sheet for the Elco printing method was obtained.

COMPARATIVE EXAMPLE 1

A record sheet was obtained in the same manner as in Example 1 except not carrying out the super calender treatment.

COMPARATIVE EXAMPLE 2

A record sheet was obtained in the same manner as in Example 2 except not carrying out the super calender treatment.

COMPARATIVE EXAMPLE 3

A record sheet was obtained in the same manner as in Example 3 except not carrying out the super calender treatment.

COMPARATIVE EXAMPLE 4

Into 880 parts by weight of water were incorporated 100 parts by weight of alumina sol (trade name "Alumina sol-100, produced by Nissan Chemical Industry Co., Ltd.) and 100 parts by weight of polyvinyl alcohol (trade name "PVA-110", produced by Kuralay Co., Ltd.). A coating solution thus obtained was coated on the above Base sheet A by means of air knife coater to become a coat amount of 5 g/m$^2$. Thus, a record sheet was obtained.

COMPARATIVE EXAMPLE 5

Into 880 parts by weight of water were incorporated 100 parts by weight of alumina sol (trade name "Alumina sol-100 produced by Nissan Chemical Industry Co., Ltd.) and 20 parts by weight of polyvinyl alcohol (trade name "PVA-110", parts by weight of polyvinyl alcohol (trade name "PVA-110", produced by Kuralay Co., Ltd.). A coating solution thus obtained was coated on the above Base sheet B by means of air knife coater to become a coat amount of 5 g/m$^2$. Thus, a record sheet was obtained.

COMPARATIVE EXAMPLE 6

As a record sheet, the above Base sheet A was used as it is.

The record sheets of the Examples and Comparative Examples were evaluated in respect of the following properties:

(1) Wet time (millisecond) obtained from a liquid absorption curve of pure water measured by a dynamic scanning absorptometer ("KM350-D1" produced by Kyowa Seiko Co., Ltd.).

(2) Absorption coefficient (ml/m$^2$s$^{-1/2}$) obtained from a liquid absorption curve of pure water measured by a dynamic scanning absorptometer (the same as the above).

(3) Contact ratio (%) measured by a specular reflection smoothness tester (produced by Toyo Seiki Seisakusho Co., Ltd.) under a pressure of 40 kg/cm$^2$ with a ray having a wavelength of 0.5 $\mu$m.

(4) Beck smoothness (second) measured in accordance with JIS P 8119.

(5) Dot reproduction rated by observing a record sheet with microscope when printed by an electro-coagulation printer (Elcorsy Technology Inc.) as follows: each tone is given a value according to three specific rules:

if all dots are present, a value of 2 is assigned if up to one fourth are missing, a value of 1 is given if more than one fourth of the dots are missing, the tone receives zero (b) second, if all dots are unbroken and unconnected, tone is assigned a value 2 if up to one fourth are broken or unconnected, a value of 1 is given if more than one fourth are broken or unconnected, tone receives a value of zero (c) third, if each dot is uniform and perfectly like every other dot, a value of 2 is assigned if up to one fourth are nonuniform, a value of 1 is given if more than one fourth are nonuniform, tone receives value of zero The printing is carried out with a black ink and each of record sheet samples of 1 cm$^2$ at 20%, 40% and 60% of dot area ratio is observed. The values given according to the above three rules are totaled and the rating is made as follows:

◎: the total is more than 17

○: the total is 15~16

Δ: the total is 10~14

×: the total is 9 or less (6) Triple color density: Optical density of printed image on the record sheet representing a triple color (black) of on the record sheet representing a triple color (black) of yellow, magenta and cyan by means of the electro-coagulation printer is measured by a color checker of Macbeth Co.

(7) Glossiness: 60° specular glossiness at the surface of record sheet is measured based upon JIS Z 8741 by means of glossimeter (trade name "MODEL TC-108 DP/A, produced by Tokyo Denshoku Co., Ltd.).

(8) Tone reproduction: As the $D^{max}$ which is a maximum optical density at the solid printing becomes higher, the tone reproduction of from zero to $D^{max}$ in the optical density is more excellent.

The results of Table 1 show that the record sheets of Examples which satisfy the requirements in respect of the wet time, absorption coefficient, contact ratio and Beck smoothness are excellent in the dot reproduction, triple color density and glossiness. Further, according to the Examples, the higher optical density of $D^{max}$ is obtained and therefore, the tone reproduction is excellent in 256 gradations of the printed record sheet.

Preparation of Base Sheet E 20 parts by weight of breached needle-leaved tree craft pulp and 80 parts by weight of breached broad-leaf tree craft pulp were beaten to become 50 ml C.S.F., and then mixed with 10 parts by weight of clay, 0.3 part by weight of paper reinforcement (trade name "POLYSTRON 191", Arakawa Chemical Industries, Ltd.), 0.3 part by weight of a sizing agent (trade name "SIZEPINE E", Arakawa Chemical Industries, Ltd.), and 2.0 parts by weight of alum. With the resultant material, Base sheet E with a weighing capacity of 100 g/m$^2$ was fabricated by a Fourdrinier paper machine in the conventional manner.

Preparation of Base Sheet F 25 parts by weight of breached needle-leaved tree craft pulp and 75 parts by weight of breached broad-leaf tree craft pulp were beaten to become 400 ml C.S.F., and then mixed with 8.5 parts by weight of talc, 1.5 parts by weight of $TiO_2$, 0.6 part by weight of a rosin sizing agent and 2.0 parts by weight of alum. With the resultant material, Base sheet F with a weighing capacity of 70 g/m$^2$ was fabricated by a Fourdrinier paper machine in the conventional manner.

Preparation of Base Sheet G 35 parts by weight of breached needle-leaved tree craft pulp and 65 parts by weight of breached broad-leaf tree craft pulp were beaten to become 400 ml C.S.F., and then mixed with 5.5 parts by weight of kaolin, 1.5 part by weight of $TiO_2$, 2.2 parts by weight of oxidized starch, 1.5 parts by weight of PAM paper reinforcement, 2.5 parts by weight of a rosin sizing agent and 4.0 parts by weight of alum. With the resultant material, Base sheet G with a weighing capacity of 85 g/m$^2$ was fabricated by a Fourdrinier paper machine in the conventional manner.

EXAMPLE 8

Into 600 parts by weight of water were incorporated 100 parts by weight of synthetic amorphous silica (trade name "Finesil, X-37 produced by Tokuyama Co., Ltd.) and 20 parts by weight of polyvinyl alcohol (trade name "PVA-110", produced by Kuralay Co., Ltd.). A coating solution thus obtained was coated on the above Base sheet E by means of air knife coater to become a coat amount of 5 g/m$^2$. A sheet thus obtained was subject to a super calender treatment with eight nips under the conditions of 200 kg/cm in nip pressure, 60° C. in metal roll temperature and 150 m/min in speed. Thus, a record sheet for the Elco printing method was obtained.

EXAMPLE 9

Into 800 parts by weight of water were incorporated 100 parts by weight of synthetic amorphous silica (trade name "Finesil X-37, produced by Tokuyama Co., Ltd.) and 60 parts by weight of polyvinyl alcohol (trade name "PVA-110", produced by Kuralay Co., Ltd.). A coating solution thus obtained was coated on the above Base sheet E by means of air knife coater to become a coat amount of 5 g/m$^2$. A sheet thus obtained was subject to a super calender treatment with eight nips under the conditions of 150 kg/cm in nip pressure, 60° C. in metal roll temperature and 150 m/min. in speed. Thus, a record sheet for the Elco printing method was obtained.

EXAMPLE 10

Into 600 parts by weight of water were incorporated 100 parts by weight of synthetic amorphous silica (trade name "Finesil X-37, produced by Tokuyama Co., Ltd.) and 20 parts by weight of polyvinyl alcohol (trade name "PVA-110", produced by Kuralay Co., Ltd.). A coating solution thus obtained was coated on the above Base sheet F by means of air knife coater to become a coat amount of 5 g/m$^2$. A sheet thus obtained was subject to a super calender treatment with eight nips under the conditions of 150 kg/cm in nip in nip pressure, 60° C. in metal roll temperature and 150 m/min. in speed. Thus, a record sheet for the Elco printing method was obtained.

EXAMPLE 11

Into 450 parts by weight of water were dispersed 40 parts by weight of colloidal silica (trade name "Snowtex –0 produced by Nissan Chemical Industry Co., Ltd.) and 10 parts by weight of polyvinyl alcohol (trade name "PVA-110", produced by Kuralay Co., Ltd.). A coating solution thus obtained was coated on the above Base sheet F by means of air knife coater to become a coat amount of 5 g/m$^2$. A sheet thus obtained was subject to a super calender treatment with eight nips under the conditions of 150 kg/cm in nip pressure, 60° C. in metal roll temperature and 150 m/min. in speed. Thus, a record sheet for the Elco printing method was obtained.

EXAMPLE 12

Into 600 parts by weight of water were incorporated 100 parts by weight of synthetic amorphous silica (trade name "Finesil X-37 produced by Tokuyama Co., Ltd.) and 20 parts by weight of polyvinyl alcohol (trade name "PVA-110", produced by Kuralay Co., Ltd.). A coating solution thus obtained was coated on the above Base sheet G by means of air knife coater to become a coat amount of 5 g m$^2$. A sheet thus obtained was subject to a super calender treatment with eight nips under the conditions of 150 kg/cm in nip pressure, 60° C. in metal roll temperature and 150 m/min. in speed. Thus, a record sheet for the Elco printing method was obtained.

EXAMPLE 13

Into 450 parts by weight of water were incorporated 40 parts by weight of colloidal silica (trade name "Snowtex –0 produced by Nissan Chemical Industry Co., Ltd.) and 10 parts by weight of polyvinyl alcohol (trade name "PVA-110", produced by Kuralay Co., Ltd.). A coating solution thus obtained was coated on the above Base sheet G by means of air knife coater to become a coat amount of 5 g/m$^2$. A sheet thus obtained was subject to a super calender treatment with eight nips under the conditions of 150 kg/cm in nip pressure, 60° C. in metal roll temperature and 200 m/min. in speed. Thus, a record sheet for the Elco printing method was obtained.

EXAMPLE 14

Into 600 parts by weight of water were incorporated 100 parts by weight of synthetic amorphous silica (trade name "FINESIL-X37B" Produced by Tokuyama Co., Ltd.) and 20 parts by weight of polyvinyl alcohol (trade name "PVA-100", produced by Kuralay Co., Ltd.). A coating solution thus obtained was coated on the above Base sheet A by means of air knife coater to become a coat amount of 3 g/m$^2$. Further, on the coating layer thus obtained was coated the same coating solution as the above to become a coat amount of 2 g/m$^2$, thus the total of coat amount being 5 g/m$^2$. A sheet thus obtained was subject to a super calender treatment with eight nips under the conditions of 200 kg/cm in nip pressure, 60° C. in metal roll temperature and 150 m/min in speed. Thus, a record sheet for the Elco printing method was obtained.

EXAMPLE 15

Into 450 parts by weight of water were dispersed 40 parts by weight of a pearl necklace like silica sol (trade name "Snowtex PS-M", produced by Nissan Chemical Industry Co., Ltd.) and 4 parts by weight of polyvinyl alcohol (trade name "PVA –100, produced by Kuralay Co., Ltd.). A coating solution thus obtained was coated on the Base sheet A by means of blade coater to become a coat amount of 5 g/m$^2$. A record sheet thus obtained was subject to a super calender treatment with eight nips under the conditions of 200 kg/cm in nip pressure, 60° C. in metal roll temperature and 150 m/min in speed. Thus, a record sheet for the Elco printing method was obtained.

EXAMPLE 16

Into 450 parts by weight of water were dispersed 40 parts by weight of branched beads shaped spherical silica sol (trade name "Snowtex up", produced by Nissan Chemical Industry Co., Ltd.) and 4 parts by weight of polyvinyl alcohol (trade name "PVA –100, produced by Kuralay Co., Ltd.). A coating solution thus obtained was coated on the Base sheet A by means of blade coater to become a coat amount of 5 g/m$^2$. A record sheet thus obtained was subject to a super calender treatment with eight nips under the conditions of 200 kg/cm in nip pressure, 60° C. in metal roll temperature and 150 m/min. in speed. Thus, a record sheet for the Elco printing method was obtained.

COMPARATIVE EXAMPLE 7

A record sheet was obtained in the same manner as in Example 8 except not effecting the super calender treatment.

COMPARATIVE EXAMPLE 8

A record sheet was obtained in the above manner as in Example 9 except not effecting the super calender treatment.

COMPARATIVE EXAMPLE 9

A record sheet was obtained in the above manner as in Example 10 except not effecting the super calender treatment.

COMPARATIVE EXAMPLE 10

A record sheet was obtained in the above manner as in Example 11 except not effecting the super calender treatment.

COMPARATIVE EXAMPLE 11

A record sheet was obtained in the same manner as in Example 12 except not effecting the super calender treatment.

COMPARATIVE EXAMPLE 12

A record sheet was obtained in the same manner as in Example 13 except not effecting the supper calender treatment.

The record sheet of the foregoing Examples and Comparative Examples were rated in respect of the items set forth in Table 2. The rating manners are as explained in Table 1.

The results of Table 2 show that the record sheets of Examples which satisfy the requirements in respect of the wet time, absorption coefficient, contact ratio and Beck smoothness are excellent in the dot reproduction and triple color density. Further, according to the Examples, the higher optical density of $D^{max}$ is obtained and thus, the tone reproduction is excellent in 256 gradations of the printed record sheet.

Effects of the Present Invention

As mentioned above, the record sheets of the present invention for use in the Elco printing are a suitable printing sheet for reproducting a higher optical density so that it is suitable for a high grade-printing requiring an excellent tone reproduction, such as a book of paintings and a photograph. Further, in case of using the alumina filler in the coating layer, printed images of high glossiness are obtained.

TABLE 1

| | Wet time (millisecond) | Absorption coefficient ($m1/m^2\ s^{-1/2}$) | Contact ratio (%) | Beck smoothness (second) | Dot reproduction | Triple color optical density | Glossiness (%) |
|---|---|---|---|---|---|---|---|
| Example 1 | 9 | 14 | 54 | 320 | ○ | 1.62 | 46 |
| Example 2 | 9 | 15 | 54 | 350 | ○ | 1.67 | 51 |
| Example 3 | 8 | 16 | 57 | 340 | ◎ | 1.69 | 54 |
| Example 4 | 9 | 15 | 60 | 380 | ◎ | 1.74 | 65 |
| Example 5 | 8 | 16 | 65 | 380 | ◎ | 1.72 | 72 |
| Example 6 | 9 | 15 | 75 | 900 | ◎ | 1.74 | 85 |
| Example 7 | 8 | 15 | 68 | 400 | ◎ | 1.74 | 75 |
| Comparative Example 1 | 8 | 15 | 42 | 170 | Δ | 1.42 | 36 |
| Comparative Example 2 | 8 | 16 | 44 | 180 | Δ | 1.45 | 38 |
| Comparative Example 3 | 7 | 17 | 46 | 170 | Δ | 1.50 | 39 |
| Comparative Example 4 | 20 | 9 | 49 | 350 | x | 0.56 | 22 |
| Comparative Example 5 | 9 | 14 | 38 | 320 | Δ | 1.32 | 26 |
| Comparative Example 6 | 18 | 20 | 23 | 40 | x | 0.42 | 8 |

TABLE 2

| | Wet time (millisecond) | Absorption coefficient ($m1/m^2\ s^{-1/2}$) | Contact ratio (%) | Beck smoothness (second) | Dot reproduction | Triple color optical density |
|---|---|---|---|---|---|---|
| Example 8 | 8 | 14 | 60 | 400 | ◎ | 1.74 |
| Example 9 | 8 | 12 | 58 | 350 | ◎ | 1.72 |
| Example 10 | 8 | 14 | 54 | 300 | ◎ | 1.74 |
| Example 11 | 9 | 14 | 60 | 400 | ○ | 1.70 |
| Example 12 | 8 | 13 | 58 | 350 | ◎ | 1.74 |
| Example 13 | 7 | 14 | 56 | 300 | ◎ | 1.70 |
| Example 14 | 8 | 14 | 62 | 400 | ◎ | 1.76 |
| Example 15 | 8 | 16 | 62 | 380 | ◎ | 1.76 |

TABLE 2-continued

| | Wet time (millisecond) | Absorption coefficient ($m1/m^2 s^{-1/2}$) | Contact ratio (%) | Beck smoothness (second) | Dot reproduction | Triple color optical density |
|---|---|---|---|---|---|---|
| Example 16 | 8 | 14 | 59 | 350 | ⊙ | 1.72 |
| Comparative Example 7 | 7 | 15 | 45 | 130 | Δ | 1.51 |
| Comparative Example 8 | 7 | 12 | 45 | 140 | Δ | 1.49 |
| Comparative Example 9 | 7 | 15 | 43 | 130 | Δ | 1.52 |
| Comparative Example 10 | 8 | 15 | 46 | 140 | Δ | 1.45 |
| Comparative Example 11 | 7 | 14 | 42 | 120 | Δ | 1.51 |
| Comparative Example 12 | 8 | 15 | 45 | 140 | Δ | 1.47 |

What is claimed is:

1. A record sheet for use in an electro-coagulation printing method by forming characters and images on a cylinder as a positive electrode with an ink which brings about colored-coagulated colloids by electric charge and transferring the characters and images under a pressed condition to the record sheet brought into contact with the surface of the positive electrode, said record sheet comprising a base sheet and a coating layer provided thereon composed of at least one filler selected from the group consisting of alumina sol, boemite, pseudo boemite, silica sol and colloidal silica and a binder, wherein said record sheet satisfies the following properties;

(i) a wet time of the record sheet obtained from a liquid absorption curve of pure water measured by a dynamic scanning absorptometer being not more than 15 milliseconds, (ii) an absorption coefficient of the record sheet obtained from a liquid absorption curve of pure water measured by a dynamic scanning absorptometer being at least 10 $ml/m^2s^{-1/2}$, and (iii) a contact ratio of the record sheet with the coagulated colloids measured by a specular reflection smoothness tester under a pressure of 40 $kg/cm^2$ with a ray having a wavelength of 0.5 $\mu$m being at least 40% and further, (iv) a Beck smoothness of the coating layer surface measured in accordance with JIS P 8119 being 250 seconds or more.

2. The record sheet according to claim 1, wherein said base sheet is made of papers, films of high smoothness, synthetic papers, coated papers, papers of high cushion and nonwoven fabrics.

3. The record sheet according to claim 1, wherein said Beck smoothness is 300 seconds or more.

4. The record sheet according to claim 1, wherein said silica sol is a connected spherical colloidal silica in form of a string of beads with long chain, a branched shape or bended shape thereof, or a pearl necklace like shape thereof.

5. The record sheet according to claim 4, wherein said connected spherical colloidal silica is of a pearl necklace like-shape which is made of a spherical colloidal silica with 10~50 nm in a particle size, having a connection length of 50~400 nm.

6. A record sheet for use in an electro-coagulation printing method by forming characters and images on a cylinder as a positive electrode with an ink which brings about colored-coagulation colloids by electric charge and transferring the characters and images under a pressed condition to the record sheet brought into contact with the surface of the positive electrode, said record sheet comprising a base sheet and a multilayer coated thereon, wherein each layer of said multilayer is composed of at least one filler selected from the group consisting of alumina sol, boemite, pseudo boemite, silica sol and colloidal silica and a binder, and wherein a top layer of said record sheet satisfieds the following properties:

(i) a wet time of the record sheet obtained from a liquid absorption curve of pure water emsured by a dynamic scanning absortometer being not more than 15 milliseconds, (ii) an aborption coefficient of the record sheet obbtained from a liquid absorption curve of pure water measured by a dynamic scanning absorptometer being at least 10 $ml/m^2s^{-1/2}$, and (iii) a contact ratio of the record sheet with the coagulated colloids measrured by a specular reflection smoothness tester under a pressure of 40 $kg/cm^2$ with a ray having a wavelength of 0.5$\mu$ being at least 40% and further, (iv) a Beck smoothness of the coating layer surface measured in accordance with JIS P 8119 being 250 seconds or more.

7. The record sheet according to claim 6 wherein said base sheet is made of papers, films of high smoothness, synthetic papers, coated papers, papers of high cushion and nonwoven fabrics.

8. The record sheet according to claim 6, wherein said Beck smoothness is 300 seconds or more.

9. The record sheet according to claim 6, wherein said silica sol is a connected spherical colloidal silica in form of a string of beads with long chain, a branched shape or bended shape thereof, or a pearl necklace like shape thereof.

10. The record sheet according to claim 9, wherein said connected spherical colloidal silica is of a pearl necklace like-shape which is made of a spherical colloidal silica with 10~50 nm in a particle size, having a connection length of 50~400 nm.

* * * * *